US005565126A

United States Patent [19]

Kimura et al.

[11] Patent Number: 5,565,126

[45] Date of Patent: Oct. 15, 1996

[54] LUBRICATING COMPOSITION

[75] Inventors: Hiroshi Kimura; Ko Yaegashi, both of Fujisawa, Japan

[73] Assignee: Kyodo Yushi Co., Ltd., Tokyo, Japan

[21] Appl. No.: 411,946

[22] Filed: Mar. 28, 1995

[51] Int. Cl.[6] ..... C10M 169/06

[52] U.S. Cl. ..... 508/208; 508/223; 508/257; 508/307; 508/464; 508/552; 508/591

[58] Field of Search ..... 252/12, 42.1

[56] References Cited

U.S. PATENT DOCUMENTS 4,256,591 3/1981 Yamamoto et al. ..... 252/12

4,732,920 3/1988 Graham et al. ..... 523/145

*Primary Examiner*—Jacqueline V. Howard

*Attorney, Agent, or Firm*—Oblon, Spivak, McClelland, Maier & Neustadt, P.C.

[57] ABSTRACT

A lubricating composition comprises a lubricating grease and a heat-curable resin selected from the group consisting of urea resins, malamine-formaldehyde resins, epoxy resins, furan resins, xylene resins, silicone resins and urethane resins. The lubricating composition permits the solution of the problem of scattering and/or sags and runs thereof from portions to be lubricated, can be molded into a variety of shapes and can show a sealing function by itself. The lubricating composition can serve not only as a lubricant, but also as a rust preventing and a coating agent.

10 Claims, No Drawings

LUBRICATING COMPOSITION

BACKGROUND OF THE INVENTION

The present invention relates to a lubricating composition and more particularly to a lubricating composition which does not cause any scattering and/or sags and runs from the portions to be lubricated observed during supplying the lubricating oil to the lubricated portions. The lubricating composition of the present invention can be used for lubrication between pulleys and wires of ropeways, gondolas and ski lifts; lubrication of wires twisted into a wire rope together with a core wire; lubrication of various kinds of rails such as crane-travelling rails, shutter rails, blined rails and guide rails; lubrication of door hinges and chains; or used in an agent for protecting rails for railway carriages from abrasion, various kinds of sealing agents and various kinds of bearings.

A lubricating oil or grease has conventionally been applied to portions to be lubricated such as those described above for the purpose of lubrication, but scattering and/or sags and runs of the lubricating oil or grease from the lubricated portions become a cause of environmental pollution. Alternatively, the lubrication of such portions has also been carried out while making use of a lubricating oil leaked out of a resin impregnated with the lubricating oil. However, this method is limited in the kinds and amounts of lubricating oils with which resins are impregnated and the processing of such resin is difficult. Therefore, this method is not always satisfied.

To ensure smooth lubrication of portion to be lubricated, a lubricating oil or grease has conventionally been supplied to the portions. However, the lubricating oil suffers from a problem of scattering and/or sags and runs of the oil from the lubricated portions which, in turn, become a cause of pollution of the working environment depending on various factors such as temperature and conditions for using the same. On the other hand, the grease has properties similar to the lubricating oil as the NLGI consistency thereof is softened and thus suffers from the same problem discussed above in connection with the lubricating oil.

SUMMARY OF THE INVENTION

Accordingly, an object of the present invention is to provide a lubricating composition which permits the solution of the foregoing problem of scattering and/or sags and runs thereof from portions to be lubricated, capable of being molded into a variety of shapes and which can show a sealing function by itself.

Another object of the present invention is to provide a lubricating composition which can serve not only as a lubricant, but also as a rust preventive and a coating agent.

The inventors of this invention have conducted various studies to accomplish the foregoing objects, have found out that a solidified lubricating composition, which permits the solution of the problem of scattering and/or sags and runs thereof from portions to be lubricated, can be obtained by incorporating a specific heat-curable resin onto a grease and thus have completed the present invention.

According to the present invention, there is provided a lubricating composition which comprises a lubricating grease and a heat-curable resin incorporated therein, selected from the group consisting of urea resins, melamine-formaldehyde resins, epoxy resin, furan resins, xylene resins, silicone resins and urethane resins.

DESCRIPTION OF THE PREFERRED EMBODIMENTS

The present invention will hereunder be described in more detail.

In the lubricating composition of the present invention, the mixing ratio of the lubricating grease to the heat-curable resin component ranges from 5 : 95 to 80 : 20, preferably 30 : 70 to 70 : 30.

The lubricating grease used in the lubricating composition is preferably at least one member selected from the group consisting of metallic soap based lubricating greases and non-metallic soap based lubricating greases.

According to a preferred embodiment of the lubricating composition, it comprises (a) a lubricating grease comprising at least one member selected from the group consisting of metallic soap based lubricating greases and non-metallic soap based lubricating greases; and a heat-curable resin comprising (b) an isocyanate composition and (c) an active hydrogen atom-containing composition capable of reacting with the isocyanate composition. In the lubricating composition, the total amount of the components (b) and (c) ranges from 20 to 95% by weight, preferably 30 to 70% by weight and more preferably 40 to 60% by weight based on the total weight of the lubricating composition. This is because, if the amount is less than 20% by weight, the resulting lubricating composition is too soft to give a solid lubricating composition, while if it exceeds 95% by weight, the resulting lubrtciating composition is as hard as a resin. This results in a decrease in the amount of the lubricant leaked out of the composition and hence leads to incomplete lubrication of portions to be lubricated.

The component (a) of the lubricating composition of the present invention is at least one member selected from the group consisting of metallic soap based lubricating greases and non-metallic soap based lubricating greases. Examples thereof include lithium greases, calcium greases, aluminum greases, lithium complex greases, calcium complex greases, aluminum complex greases, diurea greases, triurea greases, tetraurea greases, polyurea greases, and greases containing PTFE (polytetrafluoroethylene) is a thickener. The base oils and additives present in these greases may be those commonly used in the lubricating greases. The greases may, if necessary, include other additives such as antioxidants, rust inhibitors, extreme pressure agents and/or solid lubricants.

Examples of the heat-curable resins used in the lubricating composition are urea resin, melamine-formaldehyde resins, epoxy resins, furan resins, xylene resin, silicone resins and urethane resins, with epoxy resins and urethane resins being preferred. More preferred resins are urethane resins, in particular, those comprising isocyanate compositions and active hydrogen atom-containing composition capable of reacting with the isocyanate composition.

The component (b), i.e., isocyanate composition used in the lubricating composition is those having a content of isocyanate groups preferably ranging from 1 to 55% and more preferably 1 to 40%. Moreover, the component (b) preferably has a molecular weight ranging from 250 to 10,000. Such urethane polymers may be any commercially available one such as HI-PRENE P-820, HI-PRENE P-302, HI-PRENE P-305, HI-PRENE P-306, HI-PRENE P-760, HI-PRENE Ax-596C and HI-PRENE L-100, (they are all available from MITSUI TOATSU INDUSTRIES, INC.);

CORONATE C-4080, CORONATE C-4090, CORONATE C-4095, CORONATE C-4099, CORONATE C-4076, CORONATE C-4047 and CORONATE C-4048 (they are all available from NIPPON POLYURETHANE INDUSTRY CO., LTD.); ADEKA RESIN UP-302, ADEKA RESIN UP-340 and ADEKA RESIN UP-848 (they are all available from ASAHI DENKA KOGYO K.K.); and SANPRENE SEL No. 3, SANPRENE SEL No. 23 and SANPRENE SEL-7460 (they are all available from SANYO CHEMICAL INDUSTRIES, LTD.).

The component (c), i.e., the active hydrogen atom-containing composition capable of reacting with the component (b) used in the lubricating composition may be, for instance, diamines; various kinds of polyamines such as aromatic polyamines and aliphatic polyamines; and various kinds of polyols such as polymers polyols and polyether polyols. Preferred are aromatic polyamines having amino groups ranging from 1 to 40%. Examples of such aromatic polyamine curing agents include commercially available ones such as MC-506, MC-591, MC-100, MC-300, AE-302 and MDA-220 (they are all available from MITSUI TOATSU INDUSTRIES, INC.); and ADEKA HARDENER CA 125 (available from ASAHI DENTA KOGYO K.K.).

The lubricating composition of the present invention may be prepared by first blending the foregoing components (a) and (b), then incorporating the component (c) into the resulting mixture and molding it into a desired shape; or first blending the foregoing components (a) and (c), then incorporating the component (b) into the resulting mixture and molding it into a desired shape. After the formation of the mixture, it is degassed, allowed to stand at a temperature ranging from room temperature to 150° C. for a few minute to about 24 hours and then formed into a desired shape. The hardness of the lubricating composition of the present invention thus formed may vary from a hardness such that the oil and lubricating grease are leaked out of the resin by pressing it with a finger to a hardness such that a very small amount of the lubricant is leaked since the composition is almost in a resinous condition, depending on the mixing ration of the lubricating grease to the heat-curable resin and the kind of the heat-curable resins selected. The present invention also encompasses the foregoing lubricating composition which is formed into a shape adapted to the portions to be lubricated.

The heat-curable resin usable herein is not restricted to specific ones, but preferably urethane resins. The urethane resin prepared from the foregoing component (b) and (c) has already been used in tracks of a stadium for field and track events, but has not yet used in a lubricant. In addition, such urethane resin has not been used in combination with greases and the present invention is the first to apply the urethane resin to the lubricating composition.

According to the present invention, it is also possible to use, as lubricating composition, a product obtained by adding natural fibers such as wool and cellulose fibers, or synthetic fibers such as polyethylene terephthalate and polyamide fibers to a lubricating oil to give a grease-like product and then adding, to the grease-like product, the components (b) and (c) defined in the present invention. The grease-like product has been known as a sealant and generally comprises 50 to 80% by weight of a lubricating oil and about 3 to 10% by weight of fibers.

The lubricating composition of the present invention can be applied to portions to be lubricated so as to accord with the shapes thereof while it is hardened to an appropriate hardness. To enhance the adhesion of the lubricating composition to portions to be lubricated, as adhesive, for instance, an urethane resin is applied to the portions and then the lubricating composition of the present invention is applied to the portions to ensure sufficient characteristic properties of the composition. When the lubricating composition is applied to various kinds of bearings such as sliding bearings and rolling bearing, it is desirable to protect portions which do not require the application of the lubricating composition with a coating film of, for instance, a wax before the application of the lubricating composition. Moreover, if the lubricating composition of the invention has a sufficient hardness, it is not necessary to use a retainer for supporting a rolling element of a bearing, i.e., the lubricating composition of the present invention can simultaneously play the role of a retainer.

Since the lubricating composition of the present invention has a high sealing functions, it may be used as retainer for various kinds of bearings, as a lubricant which can be applied to portions which require sealing functions, as a coating agent for electric wire, as a rust preventive for ropes and as a rust preventive and lubricant for ballast tanks, in addition to the application to the portions to which lubricating compositions have conventionally been applied. When the lubricating composition of the invention is applied to rolling bearings and sliding bearing, the conventionally used bearing seal or the like can be eliminated and thus the bearings may be made lighter.

Moreover, the lubricating composition permits a substantial improvement in the torque properties and the improvement in the properties would be conspicuous, in particular, at a low temperature. Moreover, the use of the lubricating composition of the present invention permits the solution of the problem of scattering and/or sags and runs thereof from portions to be lubricated and capable of being easily molded into a variety of desired shapes adapted for those of the portions to be lubricated. In addition, the lubricating composition can easily be subjected to processing and can easily be formed into various shapes such as sheet-like, stick-like and powdery shapes. Moreover, the composition can likewise be applied to portions which cannot be lubricated through the conventional grease-lubrication and oil-lubrication techniques, such as those in which lubricants are easily carried away by, for instance, steam and moisture. The lubricating composition sufficiently shows the characteristic properties by enhancing the adhesion of the lubricating composition to portions to be lubricated and therefore, the performance life thereof can be substantially extended.

The present invention will hereunder be described in more detail with reference to the following non-limitative working Examples and Comparative Examples.

EXAMPLES AND COMPARATIVE EXAMPLES

Lubricating compositions having JIS No. 3 dumbbell shapes were prepared by mixing and stirring ingredients in amounts (unit: % by weight) shown in the following Tables 1 and 2. The appearance of the resulting compositions were observed and the hardness of the compositions were likewise determined by Shore A hardness meter. Ingredients listed in Tables 1 and 2 are as follows:

Component (a)-1 (Comp. a-1): lithium stearate grease (a mineral oil lithium grease obtained by uniformly dispersing 15.0% by weight of lithium stearate in a base oil)

Component (a)-2 (Comp. a-2): lithium 12-hydroxystearate grease (a mineral oil lithium grease prepared by uniformly dispersing 7.5% by weight of lithium 12-hydroxystearate in a base oil)

Component (a)-3 (Comp. a-3): aliphatic diurea grease (a mineral oil diurea grease prepared by uniformly dispersing, in a base oil, 10.0% by weight of an urea compound obtained by addition reaction of 4,4'-diphenylmethane diisocyanate with octylamine)

Component (a)-4 (Comp. a-4): aromatic diurea grease (a mineral oil diurea grease prepared by uniformly dispersing, in a base oil, 20% by weight of an urea compound obtained by addition reaction of tolylene diisocyanate with p-toluidine)

Component (b)-1 (Comp. b-1): urethane prepolymer (HI-PRENE P-820 available from MITSUI TOATSU INDUSTRIES, INC.)

Component (b)-2 (Comp. b-2): urethane prepolymer (HI-PRENE P-302 available from MITSUI TOATSU INDUSTRIES, INC.)

Component (c)-1 (Comp. c-1): aromatic polyamine curing agent (MC-506 available from MITSUI TOATSU INDUSTRIES, INC.)

Component (c)-2 (Comp. c-2): aromatic polyamine curing agent (MC-100 available from MITSUI TOATSU INDUSTRIES, INC.)

mineral oil (M. Oil): Fukkol NT-500 (available from FUJI KOSAN CO., LTD)

synthetic oil (Polyalphaolefin : PAO) (S. Oil-PAO): LIPOLUBE 100 (available from LION CORPORATION)

synthetic oil (ester type) (S. Oil-Es): ADEKA LUB 60%01A (available from ADEKA FINE CHEMICAL CO., LTD.).

TABLE 1

| | Example No. | | | | | | | |
|---|---|---|---|---|---|---|---|---|
| Component | 1 | 2 | 3 | 4 | 5 | 6 | 7 | 8 |
| Comp. a-1 | 50.0 | — | — | — | — | — | — | — |
| Comp. a-2 | — | 50.0 | — | — | 20.0 | 80.0 | 50.0 | 50.0 |
| Comp. a-3 | — | — | 50.0 | — | — | — | — | — |
| Comp. a-4 | — | — | — | 50.0 | — | — | — | — |
| Comp. b-1 | 38.5 | 38.5 | 38.5 | 38.5 | 61.5 | 15.4 | 45.0 | — |
| Comp. b-2 | — | — | — | — | — | — | — | 47.0 |
| Comp. c-1 | 11.5 | 11.5 | 11.5 | 11.5 | 18.5 | 4.6 | — | — |
| Comp. c-2 | — | — | — | — | — | — | 5.0 | 3.0 |
| Hardness (Shore A) | 40 | 38 | 43 | 46 | 58 | 28 | 68 | 56 |

TABLE 2

| | Comparative Example No. | | | | | |
|---|---|---|---|---|---|---|
| Component | 1 | 2 | 3 | 4 | 5 | 6 |
| Comp. a-2 | 100.0 | — | — | — | — | — |
| Comp. b-1 | — | 38.5 | 38.5 | 38.5 | 50.0 | — |
| Comp. c-1 | — | 11.5 | 11.5 | 11.5 | — | 50.0 |
| M. Oil | — | 50.0 | — | — | — | — |
| Syn. Oil-PAO | — | — | 50.0 | — | 50.0 | — |
| Syn. Oil-Es | — | — | — | 50.0 | — | 50.0 |

The lubricating compositions prepared in Examples 1 to 8 were in solid forms such that the oils and greases were leaked out of the composition when pressed with a finger tip. On the other hand, the lubricating compositions of Comparative Examples 2 and 3 were in the form wherein the resins were separated from the mineral oil or the synthetic oil (PAO) and that of Comparative Example 4 caused gelation. The lubricating compositions of Comparative Examples 5 and 6 were in grease forms.

Two samples of the lubricating composition of Example 2 and the mineral oil lithium grease of Comparative Example 1 were subjected to the following two kinds of tests for determining performance life of bearings, for the purpose of comparison.

1. ASTM Performance Life Test (ASTM-D-1741)

Each sample was tested twice and the average of two measurements was calculated. Regarding the lubricating composition of Example 2, an urethane resin was first applied onto a bearing retainer, then the lubricating composition was coated on the urethane resin layer, followed by allowing the retainer to stand over a predetermined time period to solidify the composition and initiation of the test. As a result, the performance life of the composition was found to be 3440 and 2800 hours and the average thereof was correspondingly calculated to be 3120 hours. On the other hand, the performance life of the mineral oil type lithium grease as found to be 340 and 420 hours and the average thereof was correspondingly calculated to be 380 hours. Each test was carried out under the following conditions:

| | |
|---|---|
| Bearing: | deep groove ball bearing (6306 open) |
| Radial Load: | 110N (25 lbs) |
| Thrust Load: | 176N (40 lbs) |
| Number of Revolution: | 3500 rpm |
| Test Temperature: | 125° C. |
| Test Period: | operating for 20 hours, resting for 4 hours |
| Amount of Sample Applied: | 6.0 g |

2. CRC (Coordinating Research Council) Performance Life Test (ASTM D-3336)

Each sample was tested twice and the average of two measurements was calculated. Regarding the lubricating composition of Example 2, an urethane resin was first applied onto a bearing retainer, then the lubricating composition was coated on the urethane resin layer, followed by allowing the retainer to stand over a predetermined time period to solidify the composition and initiation of the test. As a result, the performance life of the composition was found to be more than 4000 hours in both of the two tests performed and accordingly, the tests were discontinued. On the other hand, the performance life of the mineral oil lithium grease was found to be 120 and 160 hours and the average thereof was correspondingly calculated to be 140 hours. Each test was carried out under the following conditions;

| | |
|---|---|
| Bearing: | deep groove ball bearing (6204 zz sealed) |
| Radial Load: | 67N (15 lbs) |
| Thrust Load: | 67N (15 lbs) |
| Number of Revolution: | 10000 rpm |
| Test Temperature: | 125° C. |
| Test Period: | continuous operation |
| Amount of Sample Applied: | 1.8 g |

The results of these tests clearly indicate that the performance life of the lubricating composition of the present invention is not less than 10 times that of the mineral oil lithium grease.

What is claimed is:

1. A lubricating composition comprising a lubricating grease and a heat-curable resin selected from the group consisting of urea resins, melamine-formaldehyde resins, epoxy resins, furan resins, xylene resins, silicone resins and urethane resins, wherein the mixing ratio of the lubricating grease to the heat-curable resin ranges from 5:95 to 80:20.

2. The lubricating composition of claim 1, consisting essentially of said lubricating grease and said heat-curable resin.

3. The lubricating composition of claim 1 wherein the grease is a member selected from the group consisting of metallic soap based lubricating greases and non-metallic soap based lubricating greases.

4. The lubricating composition of claim 1 wherein the heat-curable resin is a member selected from the group consisting of epoxy resins and urethane resins.

5. The lubricating composition of claim 1 wherein (a) the lubricating grease is a member selected from the group consisting of metallic soap based lubricating greases and non-metallic soap based lubricating greases; and the heat-curable resin comprises (b) an isocyanate composition and (c) an active hydrogen atom-containing composition reactive with the isocyanate composition (b).

6. The lubricating composition of claim 5 wherein the content of isocyanate groups present in the isocyanate composition ranges from 1 to 40%.

7. The lubricating composition of claim 5 wherein the total amount of the components (b) and (c) ranges from 30 to 70% by weight based on the total weight of the lubricating composition.

8. The lubricating composition of claim 5 wherein the grease is a member selected from the group consisting of lithium greases, calcium greases, aluminum greases, lithium complex greases, calcium complex greases, aluminum complex greases, diurea greases, triurea greases, tetraurea greases, polyurea greases, and greases containing PTFE (polytetrafluoroethylene) as a thickener.

9. The lubricating composition of claim 5 wherein the component (c) is an aromatic polyamine having a content of amino groups ranging from 1 to 40%.

10. The lubricating composition of any one of claims 1 to 9 wherein it is molded into a shape adapted for the shape of a portion to be lubricated.

* * * * *